US010190329B2

(12) United States Patent
Kobelt

(10) Patent No.: US 10,190,329 B2
(45) Date of Patent: Jan. 29, 2019

(54) METHODS, SYSTEMS, AND ASSEMBLIES FOR COVERING AN END OF A POST

(71) Applicant: Jacob Kobelt, Langley (CA)

(72) Inventor: Jacob Kobelt, Langley (CA)

(73) Assignee: Jacob Kobelt, Langley (CA)

( * ) Notice: Subject to any disclaimer, the term of this patent is extended or adjusted under 35 U.S.C. 154(b) by 0 days.

(21) Appl. No.: 15/070,540

(22) Filed: Mar. 15, 2016

(65) Prior Publication Data

US 2016/0273240 A1 Sep. 22, 2016

Related U.S. Application Data

(63) Continuation-in-part of application No. 14/661,977, filed on Mar. 18, 2015.

(30) Foreign Application Priority Data

Mar. 10, 2016 (CA) ..... 2923515

(51) Int. Cl.
*E04H 12/00* (2006.01)
*E04H 12/04* (2006.01)
*E04H 17/00* (2006.01)

(52) U.S. Cl.
CPC ..... *E04H 12/04* (2013.01); *E04H 2017/006* (2013.01)

(58) Field of Classification Search
CPC ..... E04H 17/20; E04H 2017/006
USPC ..... 52/301, 300, 835, 834; 256/1
See application file for complete search history.

(56) References Cited

U.S. PATENT DOCUMENTS

| | | | |
|---|---|---|---|
| 1,707,397 | A | 4/1929 | Hurst |
| 1,918,607 | A | 7/1933 | Lindh |
| 2,998,110 | A | 8/1961 | Hutzelman |
| 5,419,536 | A | 5/1995 | Bender |
| 5,421,556 | A | 6/1995 | Dodge et al. |
| 5,853,167 | A | 12/1998 | West et al. |

(Continued)

FOREIGN PATENT DOCUMENTS

| | | |
|---|---|---|
| CH | 77301 | 9/1918 |
| DE | 9000249 U1 | 3/1990 |

(Continued)

OTHER PUBLICATIONS

USPTO. 2015. Non-final Rejection, dated May 1, 2015, for U.S. Appl. No. 14/661,977, filed Mar. 18, 2015, entitled "Methods, Systems, and Assemblies for Covering an End of a Post" (parent to instant application).

(Continued)

*Primary Examiner* — Basil S Katcheves
(74) *Attorney, Agent, or Firm* — McDermott Will & Emery LLP

(57) ABSTRACT

A method of covering an end of a post involves engaging respective portions of a plurality of guides of a first cover body with respective ones of a plurality of vertex regions adjacent respective ones of a plurality vertices at the end of the post, wherein the plurality of guides surround a central axis of the first cover body, and wherein engaging the respective portion of at least one of the plurality of guides comprises engaging the respective portion of at least one of the plurality of guides with the respective at least one of the plurality of vertex regions along a respective at least one range of positions extending obliquely to the central axis of the first cover body. Apparatuses are also disclosed.

22 Claims, 13 Drawing Sheets

(56) References Cited

U.S. PATENT DOCUMENTS

| | | | |
|---|---|---|---|
| 6,138,422 | A | 10/2000 | Wall et al. |
| D434,001 | S | 11/2000 | Sayger |
| D435,309 | S | 12/2000 | Landefeld |
| D451,212 | S | 11/2001 | Merrick |
| D451,614 | S | 12/2001 | Merrick |
| D453,583 | S | 2/2002 | Shimada |
| D460,570 | S | 7/2002 | Grant |
| D465,036 | S | 10/2002 | Spruill |
| 6,581,335 | B2 | 6/2003 | Grant |
| 6,585,398 | B1 | 7/2003 | Haddad |
| 6,662,515 | B2 | 12/2003 | Buhrts et al. |
| 6,688,583 | B2 | 2/2004 | Merrick |
| 6,722,637 | B2 | 4/2004 | Burkart et al. |
| 6,804,921 | B2 | 10/2004 | Neylon |
| 6,874,766 | B2 | 4/2005 | Curatolo |
| D507,359 | S | 7/2005 | Steffes et al. |
| D509,603 | S | 9/2005 | Rosian |
| D509,915 | S | 9/2005 | Rosian |
| D518,190 | S | 3/2006 | Smith |
| 7,021,016 | B2 | 4/2006 | Steffes et al. |
| D534,662 | S | 1/2007 | Quigley et al. |
| 7,204,898 | B2 | 4/2007 | Fattori |
| D547,464 | S | 7/2007 | Petta et al. |
| 7,341,242 | B2 | 3/2008 | Bertato |
| D567,965 | S | 4/2008 | Deverson |
| D580,581 | S | 11/2008 | Grant |
| D624,227 | S | 9/2010 | Grant |
| D634,450 | S | 3/2011 | Stover |
| D670,405 | S | 11/2012 | Mckenzie |
| 8,317,164 | B2 | 11/2012 | Ash |
| 8,668,797 | B2 | 3/2014 | Fattori |
| 8,844,907 | B1 | 9/2014 | Davis et al. |
| D723,189 | S | 2/2015 | Knudsen |
| D726,343 | S | 4/2015 | Knudsen |
| D775,742 | S | 1/2017 | Kobelt |
| 9,739,065 | B1 | 8/2017 | DeSalle et al. |
| 2002/0043036 | A1 | 4/2002 | Nesbitt |
| 2002/0125468 | A1 | 9/2002 | Fischer |
| 2002/0148183 | A1 | 10/2002 | Grant |
| 2003/0122115 | A1 | 7/2003 | Ernst et al. |
| 2003/0168649 | A1 | 9/2003 | Weese |
| 2005/0035339 | A1 | 2/2005 | Steffes |
| 2006/0273240 | A1 | 12/2006 | Guidash et al. |
| 2008/0179472 | A1 | 7/2008 | Miller et al. |
| 2008/0265229 | A1 | 10/2008 | DiMartino |
| 2011/0180773 | A1 | 7/2011 | Pacheco |
| 2012/0018692 | A1 | 1/2012 | Langenwalter |
| 2015/0014619 | A1 | 1/2015 | Davis et al. |
| 2016/0108588 | A1 | 4/2016 | Habodasz |
| 2016/0273240 | A1 | 9/2016 | Kobelt |

FOREIGN PATENT DOCUMENTS

| | | | |
|---|---|---|---|
| DE | 20011127 | U1 | 9/2000 |
| EP | 1 253 265 | A2 | 10/2002 |
| OA | 002770180-0001 | | 10/2015 |
| OA | 002770180-0002 | | 10/2015 |

OTHER PUBLICATIONS

USPTO. 2015. Final Rejection, dated Oct. 26, 2015, for U.S. Appl. No. 14/661,977, filed Mar. 18, 2015, entitled "Methods, Systems, and Assemblies for Covering an End of a Post" (parent to instant application).

USPTO. 2016. Notice of Allowance, dated Aug. 11, 2016, for U.S. Appl. No. 29/521,248, entitled "Fencepost Cap," filed Mar. 20, 2015.

EPO. 2016. Extended European Search Report dated Aug. 8, 2016, European Application No. 16160641.3-1604, European counterpart to instant application.

Office Action issued in Design U.S. Appl. No. 29/589,358, dated Sep. 5, 2018.

METHODS, SYSTEMS, AND ASSEMBLIES FOR COVERING AN END OF A POST

CROSS-REFERENCE TO RELATED APPLICATION

This application is a continuation-in-part of U.S. patent application Ser. No. 14/661,977 filed Mar. 18, 2015. This application also claims priority to Canadian Patent Application No. 2,923,515, filed Mar. 10, 2016. The entire contents of both applications are incorporated by reference herein.

FIELD

This disclosure relates generally to covering an end of a post.

RELATED ART

Some covers for ends of posts are limited to one or a very small range of post sizes. Such covers must be manufactured in a large number of different sizes to cover different sizes of posts, or such covers may not closely fit the end of a post, or both.

Some other covers for ends of posts require fasteners that permit moisture leakage through the covers, which may allow posts (such as wood posts, for example) to rot.

SUMMARY

According to one embodiment, there is disclosed a method of covering an end of a post, the method comprising: positioning a portion of an inward-facing surface of a first cover body against the end of the post; when a first portion of a fastener is received in an opening at an upper side of the first cover body and when a second portion of the fastener is received in a recess defined by the inward-facing surface portion of the first cover body, fastening the fastener to the end of the post to fasten the first cover body to the end of the post; and coupling a second cover body to the first cover body, independently of the fastener, to cover the opening of the first cover body.

Positioning the portion of the inward-facing surface of the first cover body against the end of the post may comprise positioning respective portions of a plurality of generally planar inward-facing surfaces of the first cover body against the end of the post.

Positioning the portion of the inward-facing surface of the first cover body against the end of the post may comprise positioning the portion of the inward-facing surface of the first cover body against respective corner edges of the post between respective lateral surfaces of the post and an end surface at the top end of the post.

Fastening the fastener to the end of the post may comprise fastening the fastener to the end of the post generally parallel to an axis of the first cover body surrounded by the portion of the inward-facing surface.

Coupling the second cover body to the first cover body may comprise receiving an upward-facing projection of the first cover body in a downward-facing recess in the second cover body.

Coupling the second cover body to the first cover body may comprise receiving a downward-facing projection of the second cover body in an upward-facing recess in the first cover body.

Coupling the second cover body to the first cover body to cover the opening of the first cover body may comprise covering a width greater than a width of the opening of the first cover body.

According to another embodiment, there is disclosed a system for covering an end of a post, the system comprising a first cover body comprising: a first opening on a first side of the first cover body and sized to receive a fastener; a second opening, on a second side of the first cover body opposite the first side of the first cover body, and sized to receive the end of the post; and an inward-facing surface defining a recess open at the first and second openings. The system further comprises a second cover body configured to be coupled to the first cover body, independently of any other body, to cover the first opening.

The system may further comprise the fastener. The fastener may be sized to extend though the first opening and into the recess to be fastened to the end of the post to fasten the first cover body to the end of the post when the end of the post is received in the recess through the second opening and a generally planar end surface of the post is positioned against a portion of the inward-facing surface of the first cover body.

The inward-facing surface of the first cover body may comprise a plurality of generally planar inward-facing surfaces of the first cover body.

At least a portion of the inward-facing surface of the first cover body may surround an axis of the first cover body and may extend obliquely to the axis of the first cover body.

The first opening may be oriented to align the fastener generally parallel to the axis of the first cover body.

The first cover body may comprise a projection. The second cover body may comprise a recess. The second cover body may be configured to be coupled to the first cover body by receiving the projection of the first cover body in the recess in the second cover body.

The first cover body may comprise a recess. The second cover body may comprise a projection. The second cover body may be configured to be coupled to the first cover body by receiving the projection of the second cover body in the recess in the first cover body.

The first opening may have a first width. The second cover body, when coupled to the first cover body to cover the first opening, may cover the first opening by a second width greater than the first width.

According to another embodiment, there is disclosed a cover assembly covering an end of a post, the cover assembly comprising a first cover body comprising: a first opening on a first side of the first cover body and sized to receive a fastener; a second opening on a second side of the first cover body opposite the first side of the first cover body; and an inward-facing surface defining a recess open at the first and second openings, wherein the end of the post is received in the recess through the second opening and the end of the post is positioned against a portion of the inward-facing surface of the first cover body. The cover assembly further comprises: a fastener fastened to the end of the post, wherein a portion of the fastener is in the first opening of the first cover body to fasten the first cover body to the end of the post; and a second cover body coupled to the first cover body, independently of any other body, to cover the first opening.

The inward-facing surface of the first cover body may comprise a plurality of generally planar inward-facing surfaces of the first cover body.

The portion of the inward-facing surface of the first cover body may surround an axis of the first cover body and may extend obliquely to the axis of the first cover body.

The fastener may be generally parallel to the axis of the first cover body.

The first opening may have a first width. The second cover body may cover the first opening by a second width greater than the first width.

According to another embodiment, there is disclosed a method of covering an end of a post, the method comprising engaging respective portions of a plurality of guides of a first cover body with respective ones of a plurality of vertex regions adjacent respective ones of a plurality of vertices at the end of the post, wherein the plurality of guides surround a central axis of the first cover body, and wherein engaging the respective portion of at least one of the plurality of guides comprises engaging the respective portion of at least one of the plurality of guides with the respective at least one of the plurality of vertex regions along a respective at least one range of positions extending obliquely to the central axis of the first cover body.

Each of the plurality of vertices may be defined by an intersection of: a respective pair of adjacent ones of a plurality of corner edges, each of the plurality of corner edges between a generally planar end surface of the post and a respective one of a plurality of generally planar lateral surfaces of the post; and a respective one of a plurality of lateral edges, each of the plurality of lateral edges between a respective pair of adjacent ones of the plurality of lateral surfaces of the post.

The first cover body may comprise a plurality of inward-facing surfaces extending obliquely to the central axis of the first cover body.

Each of the plurality of guides may be defined by adjacent portions of a respective pair of adjacent ones of the plurality of inward-facing surfaces.

Each of the plurality of guides may comprise two generally parallel and spaced-apart members defining a respective channel extending obliquely to the central axis of the first cover body.

Engaging the respective portions of the plurality of guides of the first cover body with the respective ones of the plurality of vertex regions may comprise aligning the central axis of the first cover body generally parallel to a central longitudinal axis of the post.

Engaging the respective portions of the plurality of guides of the first cover body with the respective ones of the plurality of vertex regions may comprise aligning the first cover body rotationally about the central axis of the first cover body in a pre-defined rotational orientation relative to the post.

The method may further comprise, when a portion of a fastener is received through an opening of the first cover body, fastening the fastener to the end of the post such that the first cover body is fastened to the end of the post Fastening the fastener to the end of the post may comprise fastening the fastener to the end of the post such that the fastener is generally parallel to the central axis of the first cover body.

The method may further comprise coupling a second cover body to the first cover body, independently of any other body, to cover the opening of the first cover body.

According to another embodiment, there is disclosed an apparatus for covering an end of a post, the apparatus comprising: a cover body comprising a means for aligning the cover body relative to the post, wherein the means for aligning comprises a plurality of means, surrounding a central axis of the cover body, for guiding respective ones of a plurality of vertex regions adjacent respective ones of a plurality of vertices, at the end of the post, along respective ranges of positions extending obliquely relative to the central axis of the first cover body; and a means for fastening the cover body to the end of the post.

According to another embodiment, there is disclosed an apparatus for covering an end of a post, the apparatus comprising a first cover body comprising a plurality of guides surrounding a central axis of the first cover body, each of the plurality of guides configured to guide a respective one of a plurality of vertex regions adjacent a respective one of a plurality of vertices, at the end of the post, along a respective range of positions extending obliquely relative to the central axis of the first cover body.

The first cover body may comprise a plurality of inward-facing surfaces extending obliquely to the central axis of the first cover body.

Each of the plurality of guides may be defined by adjacent portions of a respective pair of adjacent ones of the plurality of inward-facing surfaces.

Each of the plurality of guides may comprise two generally parallel and spaced-apart members defining a respective channel extending obliquely to the central axis of the first cover body.

The plurality of guides may be configured to align the central axis of the first cover body generally parallel to a central longitudinal axis of the post as the plurality of guides engage the respective ones of the plurality of vertex regions.

The plurality of guides may be configured to align the first cover body rotationally about the central axis of the first cover body in a pre-defined rotational orientation relative to the post as the plurality of guides engage the respective ones of the plurality of vertex regions.

The apparatus may further comprise a fastener positionable through an opening of the first cover body to fasten the first cover body to the end of the post when the plurality of guides engage the respective ones of the plurality of vertex regions.

The opening of the first cover body may be oriented to align the fastener generally parallel to the central axis of the first cover body when the fastener is fastened to the end of the post.

The apparatus may further comprise a second cover body configured to be coupled to the first cover body, independently of any other body, to cover the opening of the first cover body.

Other aspects and features will become apparent to those ordinarily skilled in the art upon review of the following description of illustrative embodiments in conjunction with the accompanying figures.

DETAILED DESCRIPTION

Figure 1:
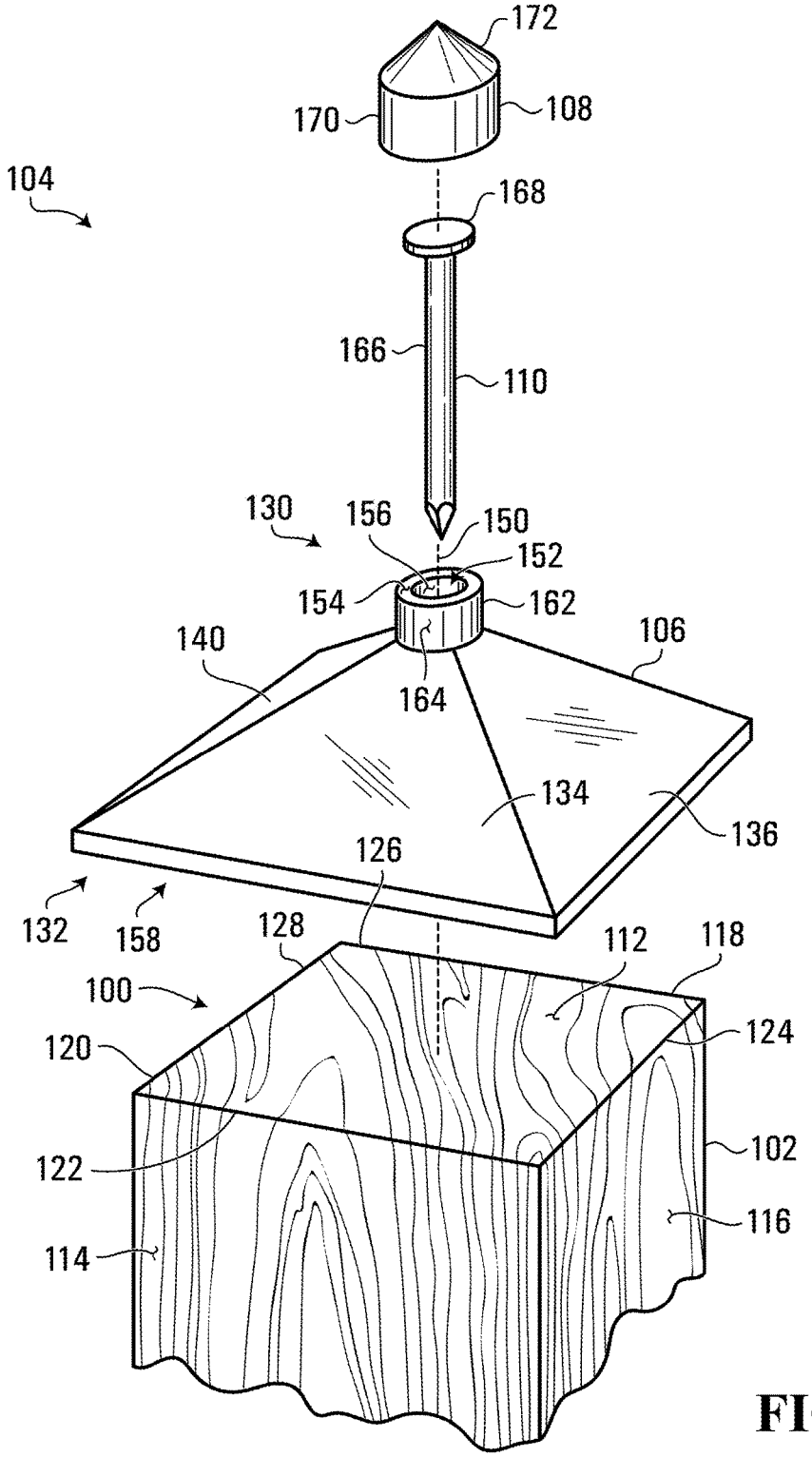
FIG. 1 is an exploded top perspective view of a system for covering an end of a post according to one embodiment.
Figure 2:
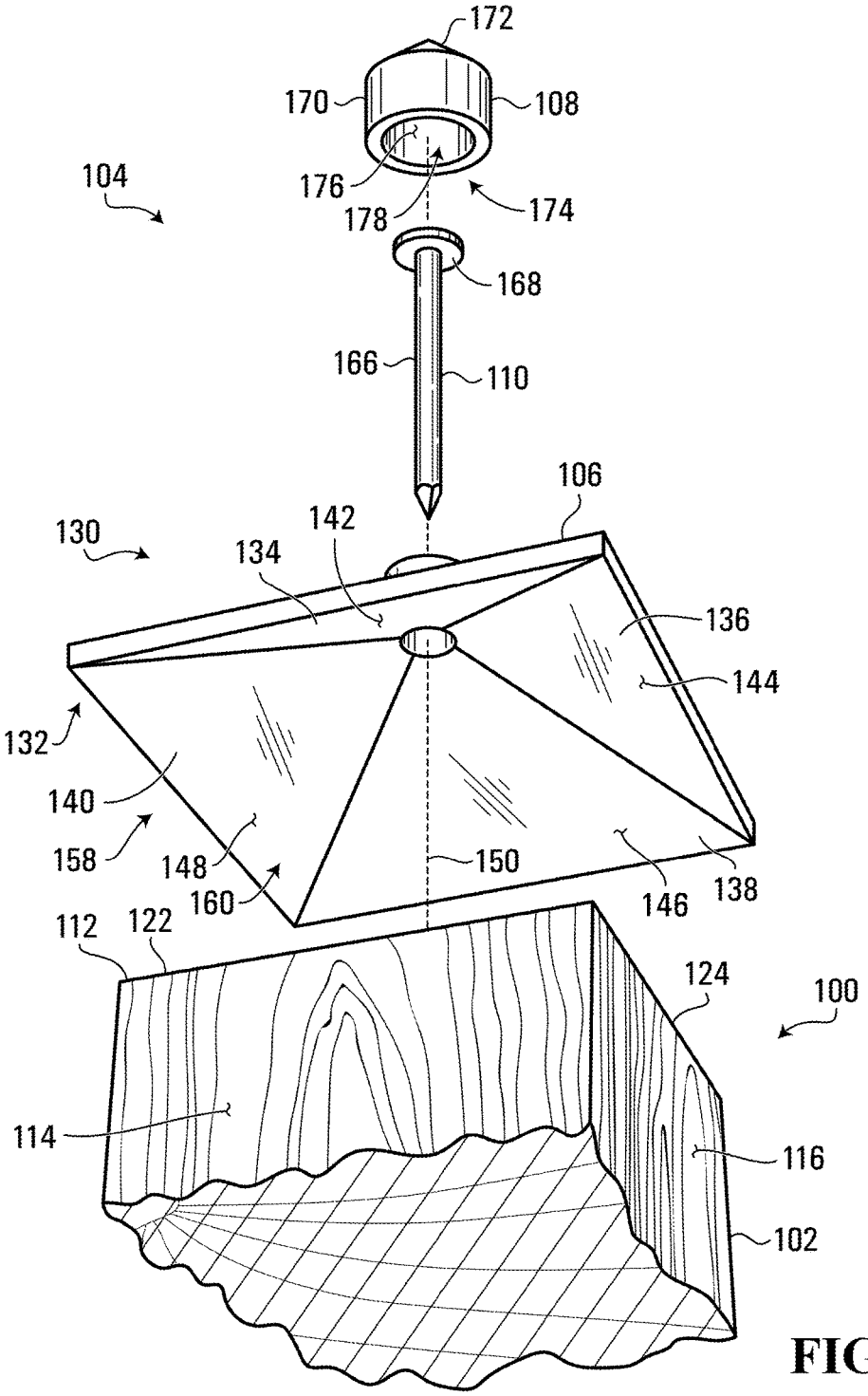
FIG. 2 is an exploded bottom perspective view of the system of FIG. 1.

Referring to FIGS. 1 and 2, a system according to one embodiment for covering an end (which in the embodiment shown in an upper end shown generally at 100) of a post 102 is shown generally at 104. The system 104 includes a first cover body 106, a second cover body 108, and a fastener 110.

In the embodiment shown, the post 102 is a wood post having a generally square cross-section, although posts in other embodiments may differ. In this context, "generally square" refers to a surface that may not be perfectly square, but that may function substantially similar to a square surface, and more generally, "generally" herein contemplates variations that may or may not be described herein and that may function substantially similar to those described herein. Therefore, the post 102 has a generally planar and generally square end surface 112 (which is an upper-end surface in the embodiment shown), generally planar lateral surfaces 114, 116, 118, and 120, and corner edges 122, 124, 126, and 128 between the lateral surfaces 114, 116, 118, and 120 respectively and the end surface 112.

The first cover body 106 may be made from plastic, metal, or one or more of various other materials, and has a first side shown generally at 130, and a second side shown generally at 132 opposite the first side 130. In the orientation shown in FIGS. 1 and 2, the first side 130 is an upper side, and the second side 132 is a lower side. The first cover body 106 has four generally triangular members 134, 136, 138, and 140 in a generally pyramidal shape such that generally planar inward-facing surfaces 142, 144, 146, and 148 of the members 134, 136, 138, and 140 respectively surround and face an axis 150 (which is a generally vertical axis in the orientation shown in FIGS. 1 and 2, and which is a central axis in the embodiment shown in FIGS. 1 and 2) of the first cover body 106 and extend obliquely to the axis 150. The surfaces 142, 144, 146, and 148 are inward-facing because they face each other and face centrally towards the common central axis 150.

At the first side 130, the first cover body 106 defines a first opening shown generally at 152, and a generally annular contact surface 154 surrounds the first opening 152. A generally cylindrical inner surface 156 surrounds the axis 150 and the first opening 152. The surface 156 is also generally parallel to the axis 150, so when a portion of the fastener 110 is received in the first opening 152, the surface 156 (and thus the first opening 152) aligns the fastener 110 generally parallel to the axis 150. Peripheral edges of the members 134, 136, 138, and 140 on the second side 132, and opposite the first opening 152, surround and define a second opening shown generally at 158 on the second side 132. The second opening 158 has a width greater than a width of the end 100 of the post 102, so the second opening 158 is sized to receive the end 100 of the post 102. The inward-facing surfaces 142, 144, 146, and 148 define a recess shown generally at 160, which is open on the first side 130 at the first opening 152 and open on the second side 132 at the second opening 158. The first cover body 106 also includes a projection 162 projecting away from the members 134, 136, 138, and 140 in a direction away from the recess 160 such that an exterior generally cylindrical surface 164 also surrounds the first opening 152 and separates the surface 154 from the members 134, 136, 138, and 140. In the orientation shown in FIGS. 1 and 2, the projection 162 is an upward-facing projection.

The fastener 110 in the embodiment shown is a nail (made from steel, for example) including a nail shaft 166 and a nail head 168. The nail shaft 166 has a width less than a width of the first opening 152, so a portion of the nail shaft 166, and thus a portion of the fastener 110, may be received in the first opening 152, and the first opening 152 is thus sized to receive a portion of the nail shaft 166 and thus a portion of the fastener 110. However, the nail head 168 has a width greater than the width of the first opening 152, so when a portion of the nail shaft 166 is received in the first opening 152, a portion of the nail head 168 may contact at least a portion of the surface 154 to co-operate with the first cover body 106 to fasten the first cover body 106 to the end 100 of the post 102 as described below.

The second cover body 108 may be made from plastic, metal, or one or more of various other materials, and includes a generally cylindrical member 170 and an end-cover member 172 covering one end of the generally cylindrical member 170. The generally cylindrical member 170 is open at an opening shown generally at 174 opposite the end-cover member 172, and a generally cylindrical inner surface 176 of the generally cylindrical member 170 defines a recess shown generally at 178 and open at the opening 174. In the orientation shown in FIGS. 1 and 2, the recess 178 is a downward-facing recess. The surface 176 is sized to contact the surface 164 in a frictional fit such that the second cover body 108 may be coupled to the first cover body 106 by receiving the projection 162 in the recess 178. The surfaces 164 and 176 are thus complementary surfaces. The frictional fit of the surfaces 164 and 176 permits the second cover body 108 to be coupled to the first cover body 106 independently of the fastener 110 and of any other body, although in other embodiments, the second cover body may be coupled to the first cover body independently of the fastener and of any other body in other ways. The generally cylindrical member 170 has a width greater than the width of the first opening 152. Therefore, when the second cover body 108 is coupled to the first cover body 106, the second cover body 108 covers the first opening 152 and a portion of the fastener 110 that would otherwise be exposed on the first side 130 of the first cover body 106.

Figure 3:
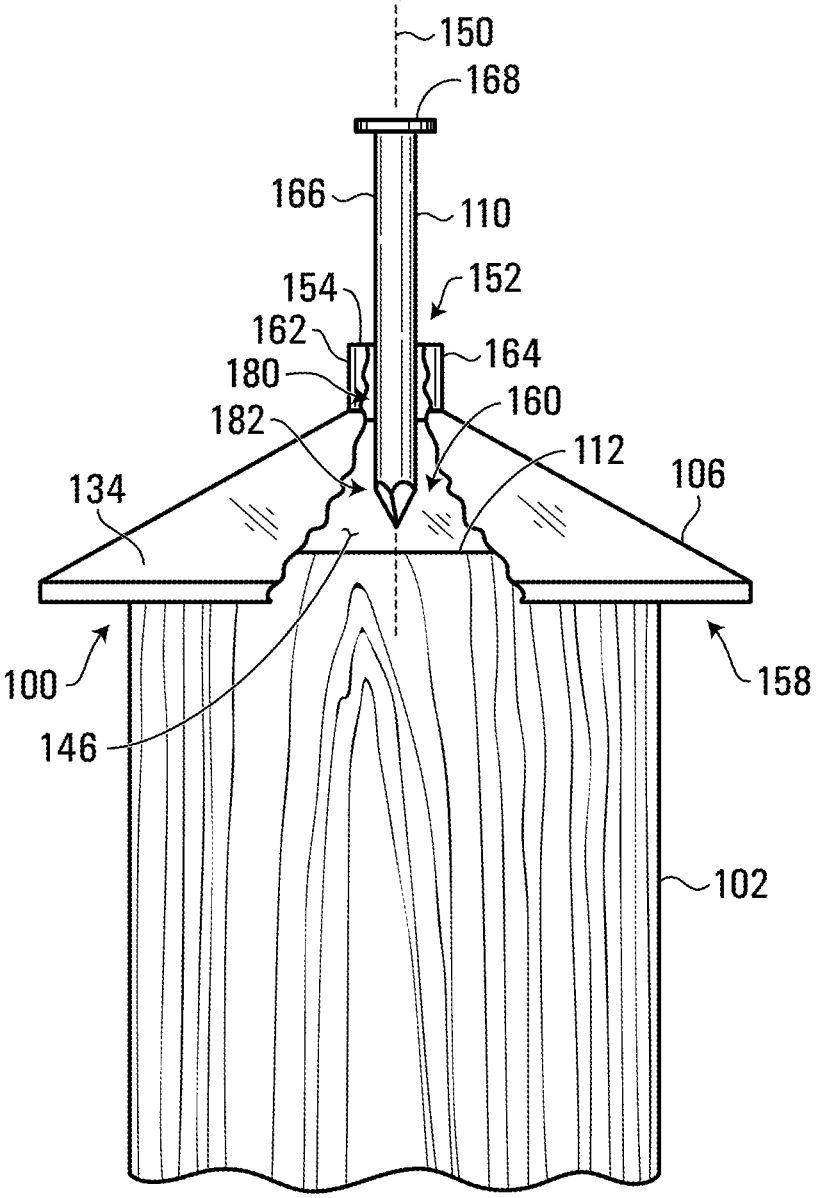
FIG. 3 is a partially broken elevation view of a post, a first cover body, and a fastener of the system of FIG. 1.
Figure 4:
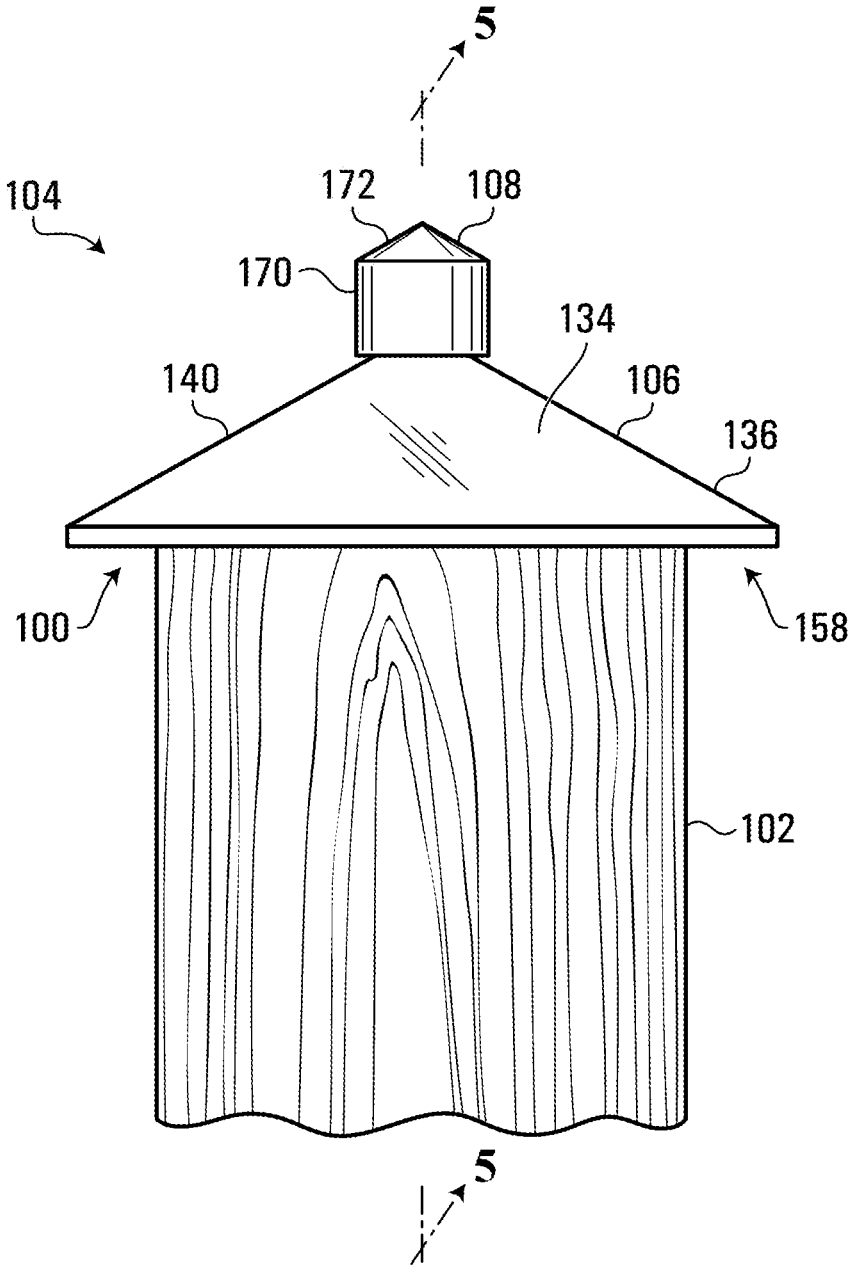
FIG. 4 is an assembled elevation view of the system of FIG. 1.
Figure 5:
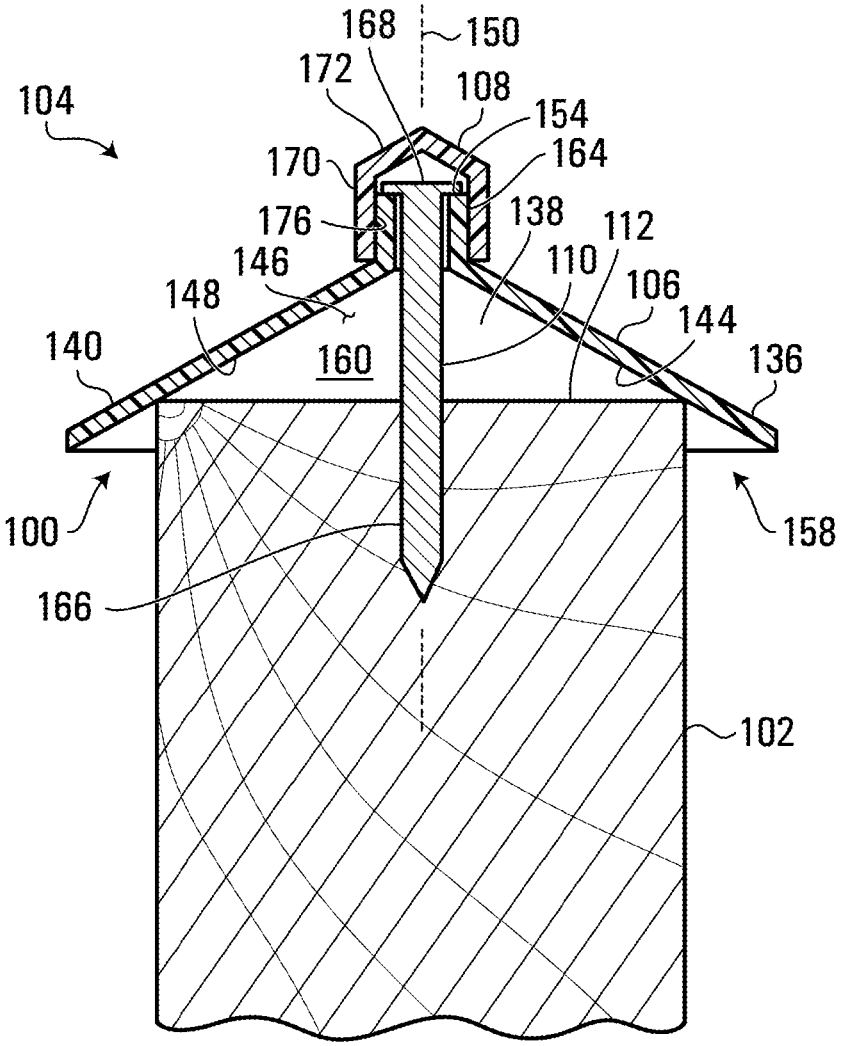
FIG. 5 is a cross-sectional view of the system of FIG. 1 along the line 5-5 in FIG. 4.

Referring to FIGS. 1-5, a method of covering the end 100 of the post 102 involves positioning a portion of the inward-facing surface 142 against the corner edge 122, a portion of the inward-facing surface 144 against the corner edge 124, a portion of the inward-facing surface 146 against the corner edge 126, and a portion of the inward-facing surface 148 against the corner edge 128, so that the portion of the inward-facing surface 142 contacts the corner edge 122, the portion of the inward-facing surface 144 contacts the corner edge 124, the portion of the inward-facing surface 146 contacts the corner edge 126, and the portion of the inward-facing surface 148 contacts the corner edge 128 as shown in FIGS. 3-5. Collectively, the portion of the inward-facing surface 142, the portion of the inward-facing surface 144, the portion of the inward-facing surface 146, and the portion of the inward-facing surface 148 are a portion of an inward-facing surface (including the inward-facing surfaces 142, 144, 146, and 148) of the first cover body 106 that surrounds the axis 150, that extends obliquely to the axis 150, and that is positioned against, and contacts, the end 100 of the post 102.

The corner edges 122, 124, 126, and 128 are a periphery of the end surface 112 of the post 102, so the portion of the inward-facing surface (including the inward-facing surfaces 142, 144, 146, and 148) of the first cover body 106 is positioned against, and contacts, the periphery of the end surface 112 of the post 102. Further, as shown in FIG. 5, the first cover body 106 defines sufficient clearance in the recess 160 to receive the end 100 of the post 102 in the recess 160 with the periphery (defined by the corner edges 122, 124, 126, and 128) of the end surface 112 of the post 102 positioned against the portion of the inward-facing surface defined by the portion of the inward-facing surface 142, by the portion of the inward-facing surface 144, by the portion of the inward-facing surface 146, and by the portion of the inward-facing surface 148 as described above.

As the portion of the inward-facing surface 142 is positioned into contact with the corner edge 122, the portion of the inward-facing surface 144 is positioned into contact with the corner edge 124, the portion of the inward-facing surface 146 is positioned into contact with the corner edge 126, and the portion of the inward-facing surface 148 is positioned into contact with the corner edge 128, as described above, portions of some or all of the inward-facing surfaces 142, 144, 146, and 148 align the first cover body 106 relative to the post 102.

More particularly, adjacent portions of the inward-facing surfaces 142 and 144 define a guide, a portion of which may engage a vertex region adjacent a vertex at the end 100 of the post 102, that vertex defined by the corner edges 122 and 124 and by a lateral edge between the generally planar lateral surfaces 114 and 116, and when a portion of that guide engages that vertex region, that guide may thus guide that vertex region along a range of positions between the adjacent portions of the inward-facing surfaces 142 and 144, which is a range of positions that extend obliquely to the axis 150. A "vertex region" may thus refer to surfaces or edges that are near a vertex and that may be engaged by guides such as those described herein.

Further, adjacent portions of the inward-facing surfaces 144 and 146 define a guide, a portion of which may engage a vertex region adjacent a vertex at the end 100 of the post 102, that vertex defined by the corner edges 124 and 126 and by a lateral edge between the generally planar lateral surfaces 116 and 118, and when a portion of that guide engages that vertex region, that guide may thus guide that vertex region along a range of positions between the adjacent portions of the inward-facing surfaces 144 and 146, which is a range of positions that extend obliquely to the axis 150.

Further, adjacent portions of the inward-facing surfaces 146 and 148 define a guide, a portion of which may engage a vertex region adjacent a vertex at the end 100 of the post 102, that vertex defined by the corner edges 126 and 128 and by a lateral edge between the generally planar lateral surfaces 118 and 120, and when a portion of that guide engages that vertex region, that guide may thus guide that vertex region along a range of positions between the adjacent portions of the inward-facing surfaces 146 and 148, which is a range of positions that extend obliquely to the axis 150.

Further, adjacent portions of the inward-facing surfaces 148 and 142 define a guide, a portion of which may engage a vertex region adjacent a vertex at the end 100 of the post 102 and defined by the corner edges 128 and 122 and by a lateral edge between the generally planar lateral surfaces 120 and 114, and when a portion of that guide engages that vertex region, that guide may thus guide that vertex region along a range of positions between the adjacent portions of the inward-facing surfaces 148 and 142, which is a range of positions that extend obliquely to the axis 150.

In summary, the aforementioned guides are configured to guide a respective one of a plurality of vertex regions adjacent a respective one of a plurality of vertices, at the end 100 of the post 102, along a respective range of positions extending obliquely relative to the axis 150. Further, the aforementioned guides surround the axis 150 and extend obliquely to the axis 150. Further, at least one such guide may engage at least one such respective vertex region to align the first cover body 106 relative to the post 102 by causing the axis 150 to be generally parallel to a central longitudinal axis of the post 102 (that is, an axis of the post 102 extending between and generally parallel to the lateral surfaces 114, 116, 118, and 120) and by causing the first cover body 106 to be in a pre-defined rotational orientation relative to the post 102 (that is, at least one rotational orientation about the axis 150 in which the aforementioned vertex regions adjacent the aforementioned vertices at the end 100 of the post 102 are in respective ones of the aforementioned guides).

Then, referring to FIG. 3, the nail shaft 166 may be positioned against the end surface 112 of the post 102 such that a first portion shown generally at 180 of the nail shaft 166 is received in the first opening 152 and a second portion shown generally at 182 of the nail shaft 166 is received in the recess 160. Then, the fastener 110 may be fastened to the end 100 of the post 102, for example by hammering the nail head 168 towards the surface 154 with the nail shaft 166 and thus the fastener 110 generally parallel to the axis 150, as shown in FIG. 5.

When the fastener 110 is fastened to the end 100 of the post 102, and when a portion of the nail head 168 contacts at least a portion of the surface 154, the fastener 110 fastens the first cover body 106 to the end 100 of the post 102, as shown in FIG. 5. Then, as shown in FIGS. 4 and 5, the second cover body 108 may be coupled to the first cover body, by receiving the projection 162 in the recess 178 in a frictional fit. In the embodiment shown, the first cover body 106 and the second cover body 108 collectively cover a width greater than a width of the end 100 of the post 102, which may protect the end 100 of the post 102 from accumulation of moisture and from damage that may be caused by accumulation of moisture, for example.

Figure 6:
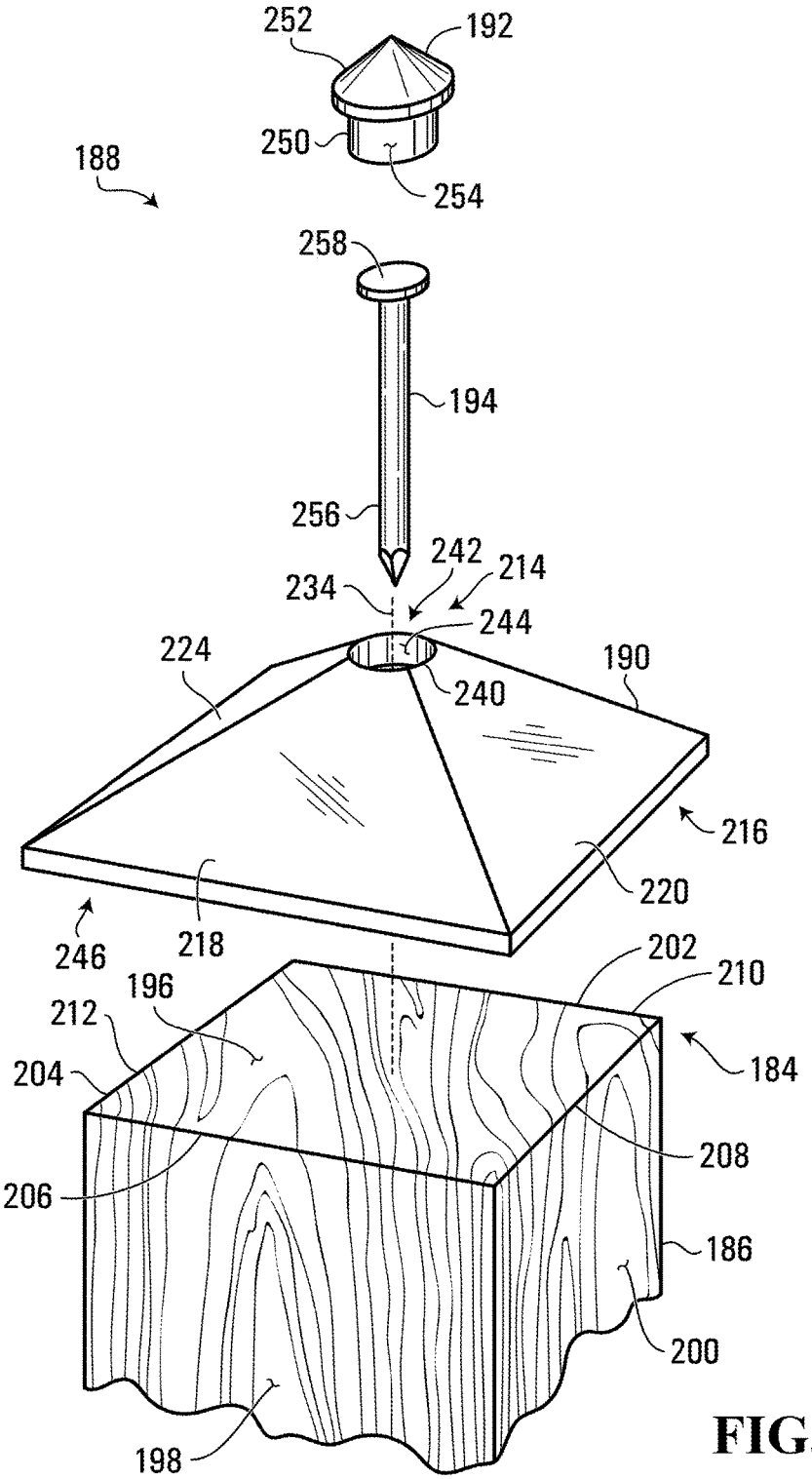
FIG. 6 is an exploded top perspective view of a system for covering an end of a post according to another embodiment.
Figure 7:
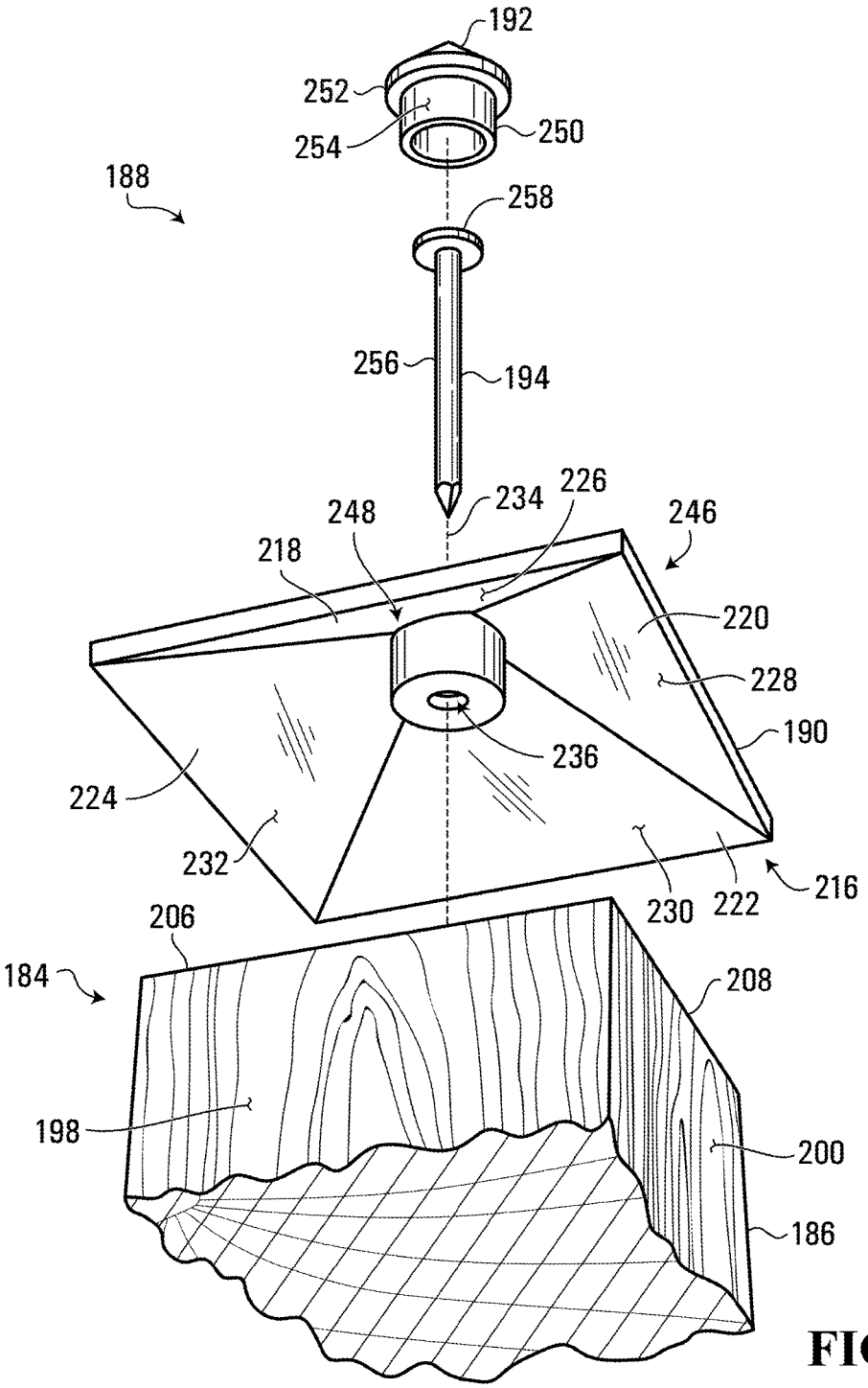
FIG. 7 is an exploded bottom perspective view of the system of FIG. 6.

Referring to FIGS. 6 and 7, a system according to another embodiment for covering an end (which in the embodiment shown is an upper end) shown generally at 184 of a post 186 is shown generally at 188. The system 188 includes a first cover body 190, a second cover body 192, and a fastener 194. The post 186 is substantially the same as the post 102 and has a generally planar and generally square end surface 196 (which is an upper-end surface in the embodiment shown), generally planar lateral surfaces 198, 200, 202, and 204, and corner edges 206, 208, 210, and 212 between the lateral surfaces 198, 200, 202, and 204 respectively and the end surface 196.

The first cover body 190 may be made from plastic, metal, or one or more of various other materials, and has a first side shown generally at 214, and a second side shown generally at 216 opposite the first side 214. In the orientation shown in FIGS. 6 and 7, the first side 214 is an upper side, and the second side 216 is a lower side. The first cover body 190 has four generally triangular members 218, 220, 222, and 224 in a generally pyramidal shape such that generally planar inward-facing surfaces 226, 228, 230, and 232 of the members 218, 220, 222, and 224 respectively surround and face an axis 234 (which is a generally vertical axis in the orientation shown in FIGS. 6 and 7, and which is a central axis in the embodiment shown in FIGS. 6 and 7) of the first cover body 190 and extend obliquely to the axis 234. The surfaces 226, 228, 230, and 232 are inward-facing because they face each other and face centrally towards the common central axis 234.

At the first side 214, the first cover body 190 defines a first opening shown generally at 236, and a generally annular contact surface 238 (shown in FIG. 9) surrounds the first opening 236. The first opening 236 also extends generally parallel to the axis 234 and thus aligns the fastener 194 generally parallel to the axis 234. The first opening 236 and the surface 238 are recessed away from an extreme edge 240 (a top edge in the orientation shown in FIGS. 6 and 7) on the first side 214 and toward the second side 216 in a recess shown generally at 242 and defined by a generally cylindrical inner surface 244 surrounding the axis 234. In the orientation shown in FIGS. 6 and 7, the recess 242 is an upward-facing recess. Peripheral edges of the members 218, 220, 222, and 224 on the second side 216, and opposite the first opening 236, surround and define a second opening shown generally at 246 on the second side 216. The second opening 246 has a width greater than a width of the end 184 of the post 186, so the second opening 246 is sized to receive the end 184 of the post 186. The inward-facing surfaces 226, 228, 230, and 232 define a recess shown generally at 248, which is open on the first side 214 at the first opening 236 and open on the second side 216 at the second opening 246.

The second cover body 192 may be made from plastic, metal, or one or more of various other materials, and includes a generally cylindrical member 250 and an end-cover member 252 covering one end of the generally cylindrical member 250. The generally cylindrical member 250 has a generally cylindrical outer surface 254 and defines a projection (a downward-facing projection in the orientation shown in FIGS. 6 and 7) from the end-cover member 252. The surface 254 is sized to contact the surface 244 in a frictional fit such that the second cover body 192 may be coupled to the first cover body 190 by receiving the projection or generally cylindrical member 250 in the recess 242. The surfaces 244 and 254 are thus complementary surfaces. The frictional fit of the surfaces 244 and 254 permits the second cover body 192 to be coupled to the first cover body 190 independently of the fastener 194 and of any other body, although in other embodiments, the second cover body may be coupled to the first cover body independently of the fastener and of any other body in other ways. The end-cover member 252 has a width greater than the width of the first opening 236, so when the second cover body 192 is coupled to the first cover body 190, the second cover body 192 covers the first opening 236 and a portion of the fastener 194 that would otherwise be exposed on the first side 214 of the first cover body 190.

The fastener 194 is substantially the same as the fastener 110 and is a nail (made from steel, for example) including a nail shaft 256 and a nail head 258. In other embodiments, the fastener 110 or the fastener 194 may be one or more other fasteners such as a screw, a bolt, a pin, a dowel, a rivet, or a screw anchor, for example, or a combination of bodies such as a threaded fastener and an anchor such as a wedge anchor or other screw anchor, for example.

The nail shaft 256 has a width less than a width of the first opening 236, so a portion of the nail shaft 256, and thus a portion of the fastener 194, may be received in the first opening 236, and the first opening 236 is thus sized to receive a portion of the nail shaft 256 and thus a portion of the fastener 194. However, the nail head 258 has a width greater than the width of the first opening 236, so when a portion of the nail shaft 256 is received in the first opening 236, a portion of the nail head 258 may contact at least a portion of the surface 238 to co-operate with the first cover body 190 to fasten the first cover body 190 to the end 184 of the post 186 as described below.

Figure 8:
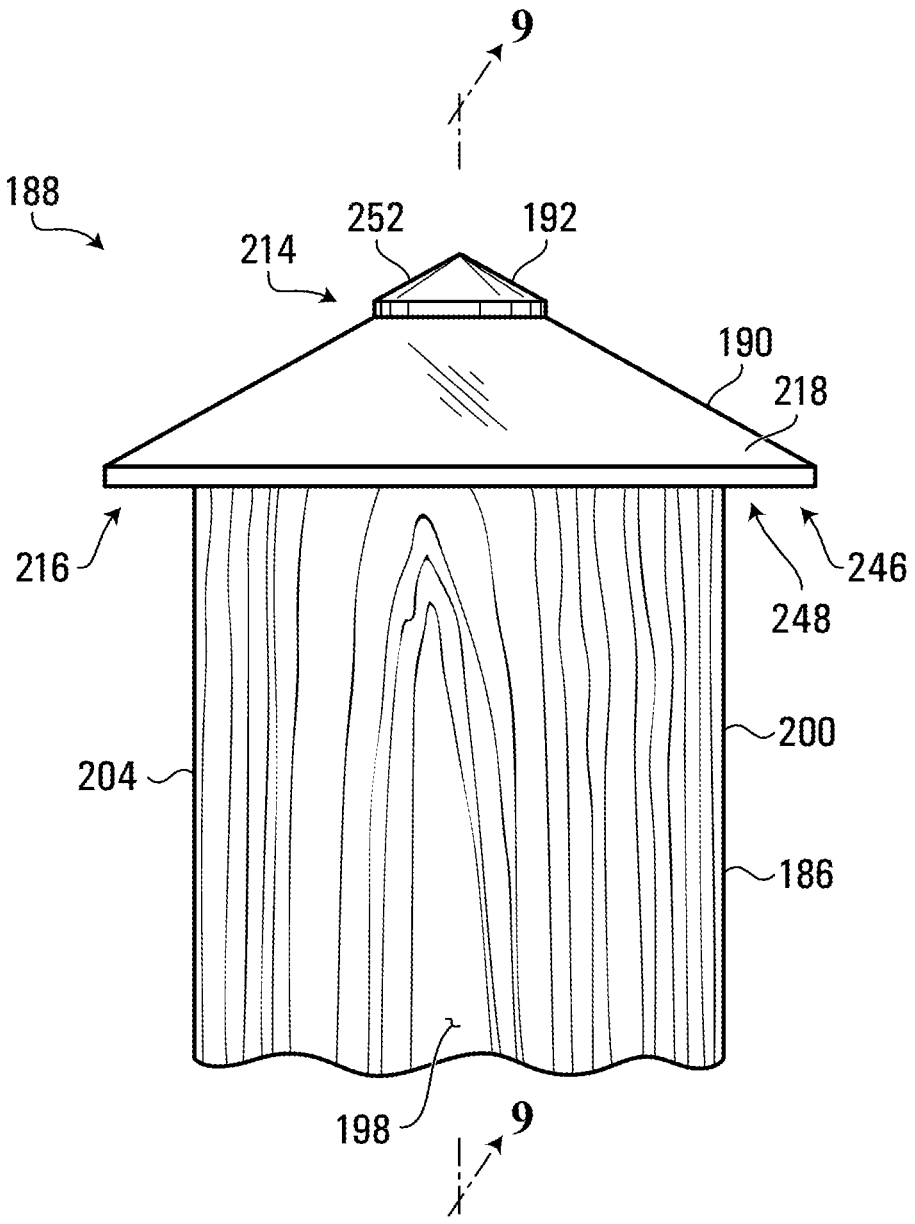
FIG. 8 is an assembled elevation view of the system of FIG. 6.
Figure 9:
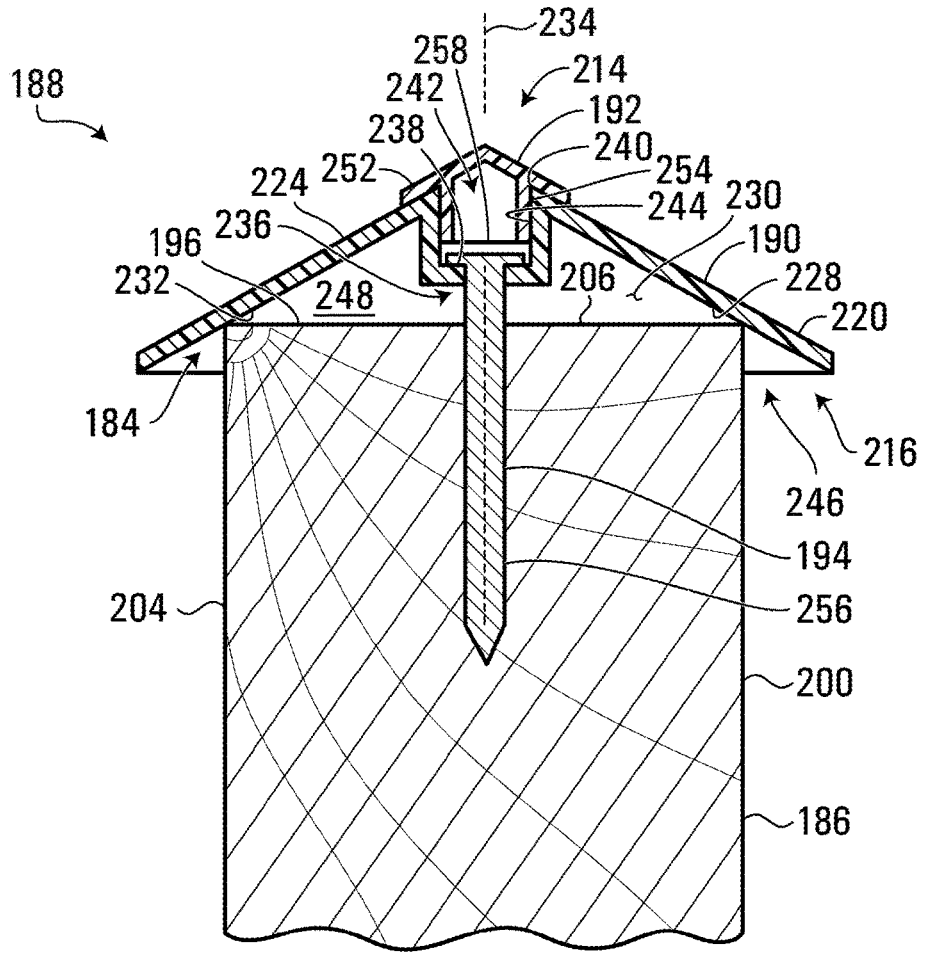
FIG. 9 is a cross-sectional view of the system of FIG. 6 along the line 9-9 in FIG. 8.

Referring to FIGS. 6-9, a method of covering the end 184 of the post 186 involves positioning a portion of the inward-facing surface 226 against the corner edge 206, a portion of the inward-facing surface 228 against the corner edge 208, a portion of the inward-facing surface 230 against the corner edge 210, and a portion of the inward-facing surface 232 against the corner edge 212, so that the portion of the inward-facing surface 226 contacts the corner edge 206, the portion of the inward-facing surface 228 contacts the corner edge 208, the portion of the inward-facing surface 230 contacts the corner edge 210, and the portion of the inward-facing surface 232 contacts the corner edge 212 as shown in FIGS. 8 and 9. Collectively, the portion of the inward-facing surface 226, the portion of the inward-facing surface 228, the portion of the inward-facing surface 230, and the portion of the inward-facing surface 232 are a portion of an inward-facing surface (including the inward-facing surfaces 226, 228, 230, and 232) of the first cover body 190 that surrounds the axis 234, that extends obliquely to the axis 234, and that is positioned against, and contacts, the end 184 of the post 186.

The corner edges 206, 208, 210, and 212 are a periphery of the end surface 196 of the post 186, so the portion of the inward-facing surface (including the inward-facing surfaces 226, 228, 230, and 232) of the first cover body 190 is positioned against, and contacts, the periphery of the end surface 196 of the post 186. Further, as shown in FIG. 9, the first cover body 190 defines sufficient clearance in the recess 248 to receive the end 184 of the post 186 in the recess 248 with the periphery (defined by the corner edges 206, 208, 210, and 212) of the end surface 196 of the post 186 positioned against the portion of the inward-facing surface defined by the portion of the inward-facing surface 226, by the portion of the inward-facing surface 228, by the portion of the inward-facing surface 230, and by the portion of the inward-facing surface 232 as described above.

As the portion of the inward-facing surface 226 is positioned into contact with the corner edge 206, the portion of the inward-facing surface 228 is positioned into contact with the corner edge 208, the portion of the inward-facing surface 230 is positioned into contact with the corner edge 210, and the portion of the inward-facing surface 232 is positioned into contact with the corner edge 212, as described above, portions of some or all of the inward-facing surfaces 226, 228, 230, and 232 align the first cover body 190 relative to the post 186.

More particularly, adjacent portions of the inward-facing surfaces 226 and 228 define a guide, a portion of which may engage a vertex region adjacent a vertex at the end 184 of the post 186, that vertex defined by the corner edges 206 and 208 and by a lateral edge between the generally planar lateral surfaces 198 and 200, and when a portion of that guide engages that vertex region, that guide may thus guide that vertex region along a range of positions between the adjacent portions of the inward-facing surfaces 226 and 228, which is a range of positions that extend obliquely to the axis 234.

Further, adjacent portions of the inward-facing surfaces 228 and 230 define a guide, a portion of which may engage a vertex region adjacent a vertex at the end 184 of the post 186, that vertex defined by the corner edges 208 and 210 and by a lateral edge between the generally planar lateral surfaces 200 and 202, and when a portion of that guide engages that vertex region, that guide may thus guide that vertex region along a range of positions between the adjacent portions of the inward-facing surfaces 228 and 230, which is a range of positions that extend obliquely to the axis 234.

Further, adjacent portions of the inward-facing surfaces 230 and 232 define a guide, a portion of which may engage a vertex region adjacent a vertex at the end 184 of the post 186, that vertex defined by the corner edges 210 and 212 and by a lateral edge between the generally planar lateral surfaces 202 and 204, and when a portion of that guide engages that vertex region, that guide may thus guide that vertex region along a range of positions between the adjacent portions of the inward-facing surfaces 230 and 232, which is a range of positions that extend obliquely to the axis 234.

Further, adjacent portions of the inward-facing surfaces 232 and 226 define a guide, a portion of which may engage a vertex region adjacent a vertex at the end 184 of the post 186, that vertex defined by the corner edges 212 and 206 and by a lateral edge between the generally planar lateral surfaces 204 and 198, and when a portion of that guide engages that vertex region, that guide may thus guide that vertex region along a range of positions between the adjacent portions of the inward-facing surfaces 232 and 226, which is a range of positions that extend obliquely to the axis 234.

In summary, the aforementioned guides are configured to guide a respective one of a plurality of vertex regions adjacent a respective one of a plurality of vertices, at the end 184 of the post 186, along a respective range of positions extending obliquely relative to the axis 234. Further, the aforementioned guides surround the axis 234 and extend obliquely to the axis 234. Further, at least one such guide may engage at least one such respective vertex region to align the first cover body 190 relative to the post 186 by causing the axis 234 to be generally parallel to a central longitudinal axis of the post 186 (that is, an axis of the post 186 extending between and generally parallel to the lateral surfaces 198, 200, 202, and 204) and by causing the first cover body 190 to be in a pre-defined rotational orientation relative to the post 186 (that is, at least one rotational orientation about the axis 234 in which the aforementioned vertex regions adjacent the aforementioned vertices at the end 184 of the post 186 are in respective ones of the aforementioned guides).

Then, the nail shaft 256 may be positioned against the end surface 196 of the post 186 such that a first portion of the nail shaft 256 is received in the first opening 236 and a second portion of the nail shaft 256 is received in the recess 248. Then, the fastener 194 may be fastened to the end 184 of the post 186, for example by hammering the nail head 258 towards the surface 238 with the nail shaft 256 and thus the fastener 194 generally parallel to the axis 234, as shown in FIG. 9. Instead of hammering the nail head 258 directly, a tool (not shown) may be positioned on the nail head 258 and the tool may be hammered to hammer the nail head 258 in the recess 242 and towards the surface 238.

When the fastener 194 is fastened to the end 184 of the post 186, and when a portion of the nail head 258 contacts at least a portion of the surface 238, the fastener 194 fastens the first cover body 190 to the end 184 of the post 186, as shown in FIG. 9. Then, as shown in FIGS. 8 and 9, the second cover body 192 may be coupled to the first cover body, by receiving the projection or generally cylindrical member 250 in the recess 242 in a frictional fit. In the embodiment shown, the first cover body 190 and the second cover body 192 collectively cover a width greater than a width of the end 184 of the post 186, which may protect the end 184 of the post 186 from accumulation of moisture and from damage that may be caused by accumulation of moisture, for example.

Figure 10:
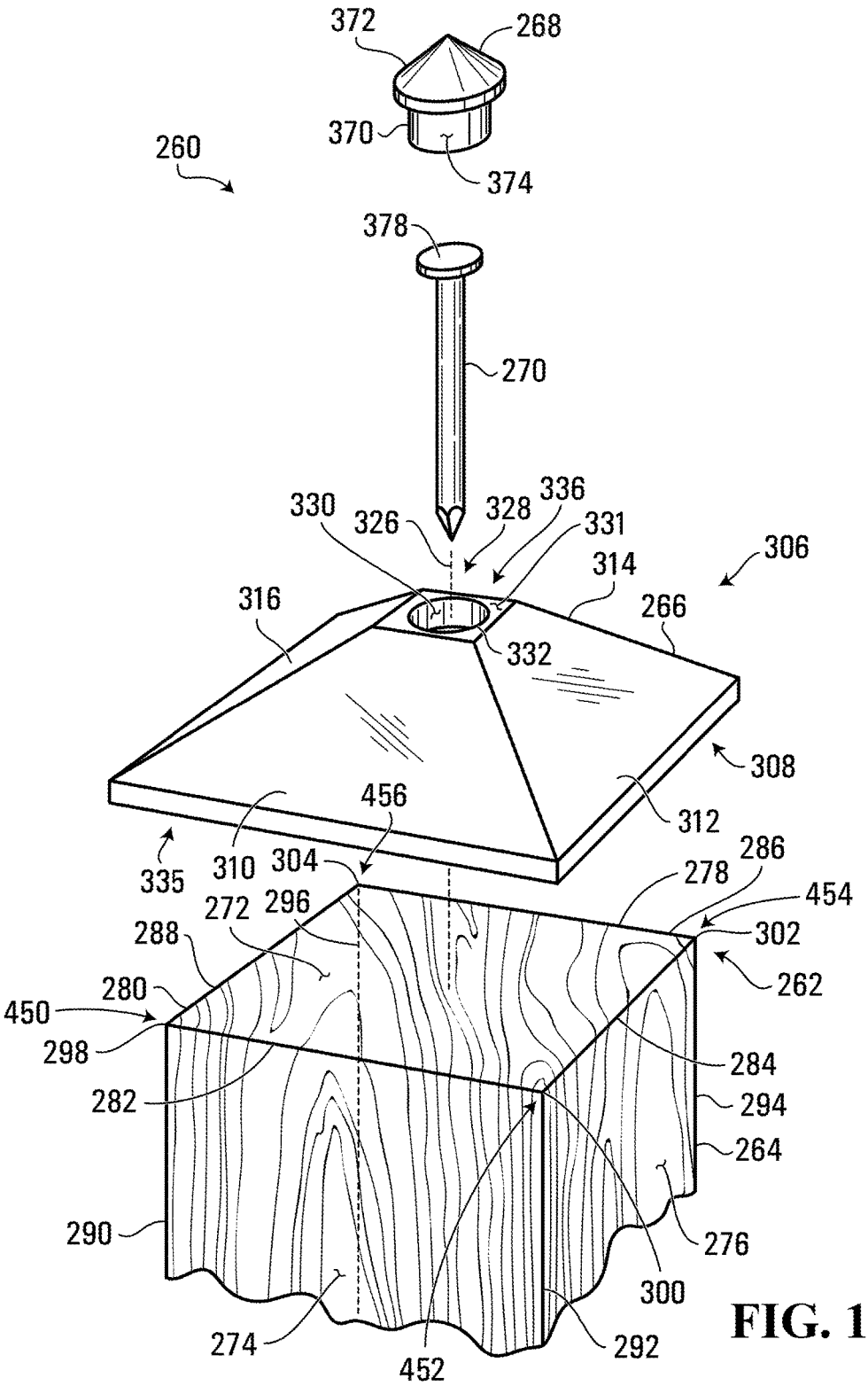
FIG. 10 is an exploded top perspective view of a system for covering an end of a post according to another embodiment.
Figure 11:
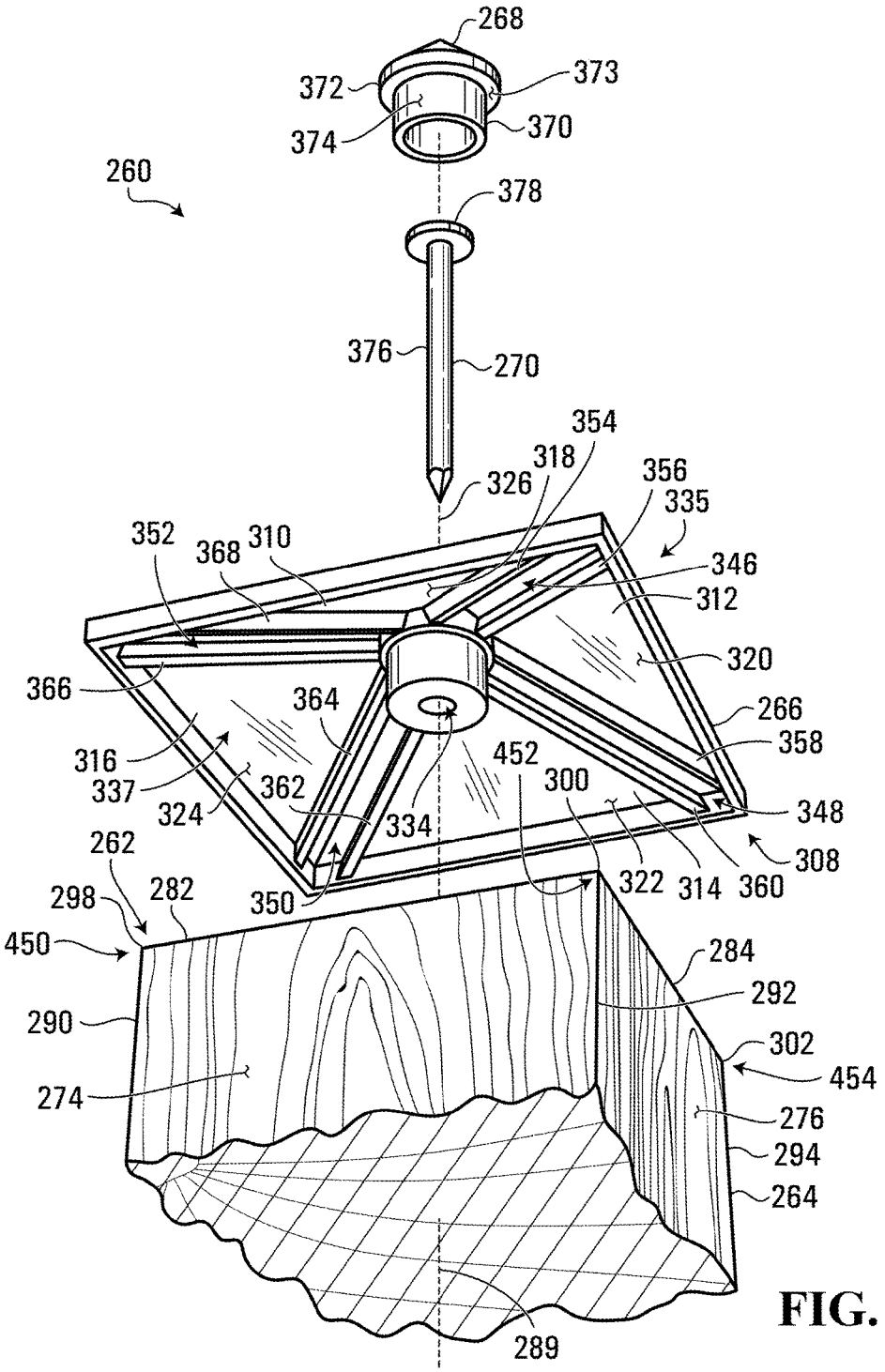
FIG. 11 is an exploded bottom perspective view of the system of FIG. 10.

Referring to FIGS. 10 and 11, a system according to another embodiment for covering an end (which in the embodiment shown is an upper end) shown generally at 262 of a post 264 is shown generally at 260. The system 260 includes a first cover body 266, a second cover body 268, and a fastener 270.

The post 264 is substantially the same as the posts 102 and 186. Accordingly, the post 264 and has a generally planar and generally square end surface 272 (which is an upper-end surface in the embodiment shown) and generally planar lateral surfaces 274, 276, 278, and 280 surrounding a vertical and central longitudinal axis 289 of the post 264.

The post 264 also has corner edges 282, 284, 286, and 288 between the lateral surfaces 274, 276, 278, and 280 respectively and the end surface 272. The post 264 also has lateral edges 290, 292, 294, and 296 defined between pairs of adjacent ones of the lateral surfaces, namely between the lateral surfaces 280 and 274, 274 and 276, 276 and 278, and 278 and 280 respectively.

The end 262 of the post 264 also has vertices 298, 300, 302, and 304. The vertex 298 is defined by an intersection of the lateral edge 290, the corner edge 288, and the corner edge 282. The vertex 300 is defined by an intersection of the lateral edge 292, the corner edge 282, and the corner edge 284. The vertex 302 is defined by an intersection of the lateral edge 294, the corner edge 284, and the corner edge 286. The vertex 304 is defined by an intersection of the lateral edge 296, the corner edge 286, and the corner edge 288. The vertices 298, 300, 302, and 304 are thus defined by an intersection of: a respective pair of adjacent ones of a plurality of corner edges, each of the plurality of corner edges between a generally planar end surface of the post and a respective one of a plurality of generally planar lateral surfaces of the post; and a respective one of a plurality of lateral edges, each of the plurality of lateral edges between a respective pair of adjacent ones of the plurality of lateral surfaces of the post. The end 262 of the post 264 also has vertex regions 450, 452, 454, and 456 adjacent, respectively, the vertices 298, 300, 302, and 304.

The first cover body 266 may be made from plastic, metal, or one or more of various other materials, and has a first side shown generally at 306, and a second side shown generally at 308 opposite the first side 306. In the orientation shown in FIGS. 10 and 11, the first side 306 is an upper side, and the second side 308 is a lower side. The first cover body 266 has four generally triangular members 310, 312, 314, and 316 in a generally pyramidal shape such that generally planar inward-facing surfaces 318, 320, 322, and 324 (shown in FIG. 11) of the generally triangular members 310, 312, 314, and 316 respectively surround and face an axis 326 (which is a generally vertical in the orientation shown in FIGS. 10 and 11, and which is a central axis in the embodiment shown in FIGS. 10 and 11) of the first cover body 266 and extend obliquely to the central axis 326. The surfaces 318, 320, 322, and 324 are inward-facing because they face each other and face centrally towards the central axis 326.

At the first side 306, the first cover body 266 has a generally circular extreme edge 332 between a generally cylindrical inner surface 330 and a generally planar contact surface 331. The extreme edge 332 defines a first opening shown generally at 328. The inner surface 330 extends between the extreme edge 332 and a generally annular contact surface 339 (shown in FIG. 13) defining a second opening 334. The generally annular contact surface 339 and the second opening 334 are recessed away from the extreme edge 332 on the first side 306 and towards the second side 308. Together, the inner surface 330 and the generally annular contact surface 339 define a recess shown generally at 336 that is open on the first side 306 at the first opening 328 and open on the second side 308 at the second opening 334.

Peripheral edges of the generally triangular members 310, 312, 314, and 316 on the second side 308, and opposite the first and second openings 328 and 334, surround and define a third opening shown generally at 335 on the second side 308. The third opening 335 has a width greater than a width of the end 262 of the post 264, so the third opening 335 is sized to receive the end 262 of the post 264. The inward-facing surfaces 318, 320, 322, and 324 extend obliquely to the central axis 326, away from the first and second openings 328 and 334, and towards the third opening 335, defining a recess shown generally at 337 that is open on the first side 306 at the second opening 334 and open on the second side 308 at the third opening 335.

Figure 12:
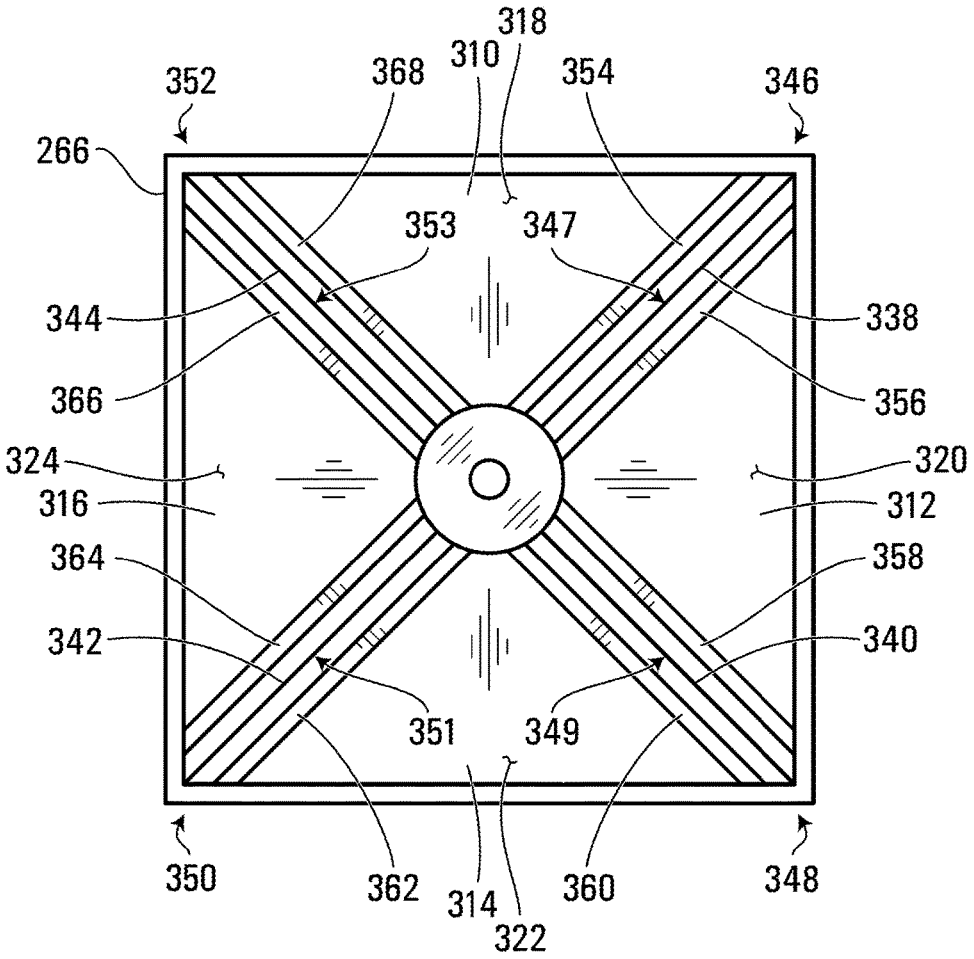
FIG. 12 is a bottom plan view of a cover body of the system FIG. 10.

Referring to FIGS. 11 and 12, the first cover body 266 also has a pyramidal edge 338 between the generally triangular members 310 and 312, a pyramidal edge 340 between the generally triangular members 312 and 314, a pyramidal edge 342 between the generally triangular members 314 and 316, and a pyramidal edge 344 between the generally triangular members 316 and 310.

The first cover body 266 also has members 354 and 356 generally parallel to and spaced apart from each other on opposite sides of the pyramidal edge 338 and projecting into the recess 337 from the generally planar inward-facing surfaces 318 and 320 respectively to define a channel shown generally at 347 between the members 354 and 356. As described below, the members 354 and 356 function as a guide shown generally at 346.

The first cover body 266 also has members 358 and 360 generally parallel to and spaced apart from each other on opposite sides of the pyramidal edge 340 and projecting into the recess 337 from the generally planar inward-facing surfaces 320 and 322 respectively to define a channel shown generally at 349 between the members 358 and 360. As described below, the members 358 and 360 function as a guide shown generally at 348.

The first cover body 266 also has members 362 and 364 generally parallel to and spaced apart from each other on opposite sides of the pyramidal edge 342 and projecting into the recess 337 from the generally planar inward-facing surfaces 322 and 324 respectively to define a channel shown generally at 351 between the members 362 and 364. As described below, the members 362 and 364 function as a guide shown generally at 350.

The first cover body 266 also has members 366 and 368 generally parallel to and spaced apart from each other on opposite sides of the pyramidal edge 344 and projecting into the recess 337 from the generally planar inward-facing surfaces 324 and 318 respectively to define a channel shown generally at 353 between the members 366 and 368. As described below, the members 366 and 368 function as a guide shown generally at 352. The members 354, 356, 358, 360, 362, 364, 366, and 368, the channels 347, 349, 351, and 353, and the guides 346, 348, 350, and 352 all surround and extend obliquely to the central axis 326.

The second cover body 268 may be made from plastic, metal, or one or more of various other materials and is substantially the same as the second cover body 192. Accordingly, the second cover body 268 includes a generally cylindrical member 370 and an end-cover member 372 covering one end of the generally cylindrical member 370. The generally cylindrical member 370 has a generally cylindrical outer surface 374 and defines a projection from the end-cover member 372. The outer surface 374 is sized to contact the inner surface 330 of the first cover body 266 in a frictional fit such that the second cover body 268 may be coupled to the first cover body 266 by receiving the projection or the generally cylindrical member 370 in the first opening 328 and the recess 336. The surfaces 330 and 374 are thus complementary surfaces. The frictional fit of the outer surface 374 and the inner surface 330 permits the second cover body 268 to be coupled to the first cover body 266 in the recess 336 independently of the fastener 270 and of any other body, although in other embodiments, the second cover body 268 may be coupled to the first cover body 266 independently of the fastener and of any other body in other ways.

The end-cover member 372 has a width greater than widths of the first opening 328 and the second opening 334, so when the second cover body 268 is coupled to the first cover body 266, the second cover body 268 covers the first opening 328, the second opening 334, and a portion of the fastener 270 that would otherwise be exposed on the first side 306 of the first cover body 266. Additionally, the end-cover member 372 includes a generally annular contact surface 373 that is configured to contact the contact surface 331 of the first cover body 266 when the first cover body 266 is coupled to the second cover body 268.

The fastener 270 is substantially the same as the fasteners 194 and 110 and is a nail (made from steel, for example) including a nail shaft 376 and a nail head 378. In other embodiments, the fastener 110, 194, or 270 may be one or more other fasteners such as a screw, a bolt, a pin, a dowel, a rivet, or a screw anchor, for example, or a combination of bodies such as a threaded fastener and an anchor such as a wedge anchor or other screw anchor, for example. The nail shaft 376 has a width less than the widths of the first opening 328 and the second opening 334, so a portion of nail shaft 376, and thus a portion of the fastener 270, may be received in the first and the second openings 328 and 334, and thus both the first and second openings 328 and 334 are sized to receive a portion of the nail shaft 376 and thus a portion of the fastener 270. However, the nail head 378 has a width less than the width of the first opening 328 but a width greater than the width of the second opening 334, so when a portion of the nail shaft 376 is received in the first and second openings 328 and 334, a portion of the nail head 378 may contact at least a portion of the annular contact surface 339 to co-operate with the first cover body 266 to fasten the first cover body 266 to the end 262 of the post 264 as described below.

Referring to FIGS. 10-13, a method of covering the end 262 of the post 264 involves positioning a portion of the inward-facing surface 318 proximate the corner edge 282, a portion of the inward-facing surface 320 proximate the corner edge 284, a portion of the inward-facing surface 322 proximate the corner edge 286, and a portion of the inward-facing surface 324 proximate the corner edge 288, as shown in FIGS. 10 and 11. When the first cover body 266 is positioned as described above, a portion of the vertex region 452 may be received in the channel 347, and surfaces and edges of the vertex region 452 engage surfaces defining the channel 347 such that the guide 346 guides the vertex region 452 along a range of positions extending along the channel 347 and thus obliquely to the central axis 326.

Further, when the first cover body 266 is positioned as described above, a portion of the vertex region 454 may be received in the channel 349, and surfaces and edges of the vertex region 454 engage surfaces defining the channel 349 such that the guide 348 guides the vertex region 454 along a range of positions extending along the channel 349 and thus obliquely to the central axis 326.

Further, when the first cover body 266 is positioned as described above, a portion of the vertex region 456 may be received in the channel 351, and surfaces and edges of the vertex region 456 engage surfaces defining the channel 351 such that the guide 350 guides the vertex region 456 along a range of positions extending along the channel 351 and thus obliquely to the central axis 326.

Further, when the first cover body 266 is positioned as described above, a portion of the vertex region 450 may be received in the channel 353, and surfaces and edges of the vertex region 458 engage surfaces defining the channel 353 such that the guide 352 guides the vertex region 458 along a range of positions extending along the channel 353 and thus obliquely to the central axis 326.

In summary, the guides 346, 348, 350, and 352 are configured to guide a respective one of the plurality of vertex regions 452, 454, 456, and 450 along a respective range of positions extending obliquely relative to the central axis 326. Further, at least one such guide may engage at least one such respective vertex region to align the first cover body 266 relative to the post 264 by causing the central axis 326 to be generally parallel to the central longitudinal axis 289 of the post 264 and by causing the first cover body 266 to be in a pre-defined rotational orientation relative to the post 264 (that is, at least one rotational orientation about the central axis 326 in which the aforementioned vertex regions at the end 262 of the post 264 are in respective ones of the aforementioned guides).

Figure 13:
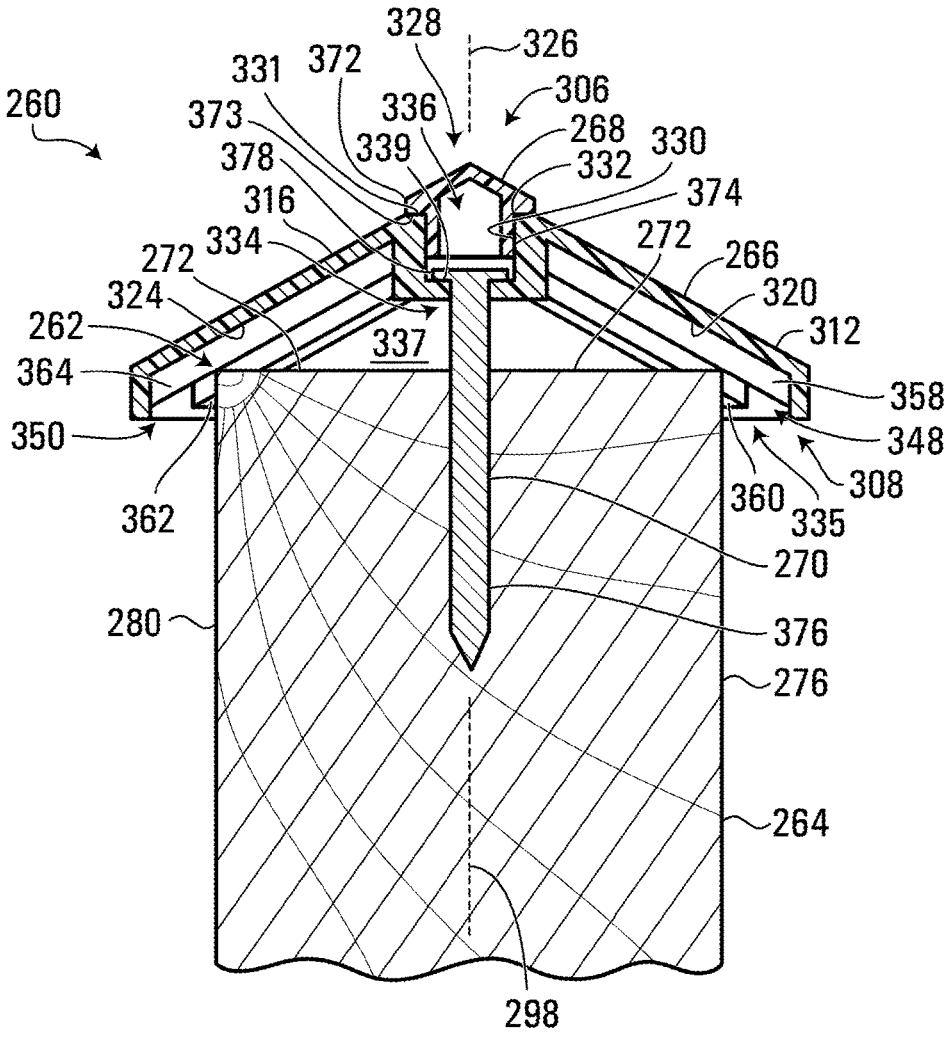
FIG. 13 is a cross-sectional view of the system of FIG. 10.

Then, the nail shaft 376 may be positioned against the end surface 272 of the post 264 such that a first portion of the nail shaft 376 is passed through the first opening 328, a second portion of the nail shaft 376 is received in the recess 336, and a third portion of the nail shaft 376 is passed through the second opening 334. Then, the fastener 270 may be fastened to the end 262 of the post 264, for example by hammering the nail head 378 towards the annular contact surface 339 with the nail shaft 376 (thus the fastener 270) generally aligned to the central axis 326 of the first cover body 266 and the central longitudinal axis 289 of the post 264, as shown in FIG. 13. Instead of hammering the nail head 378 directly, a tool (not shown) may be positioned on the nail head 378 and the tool may be hammered to hammer the nail head 378 in the recess 336 and towards the annular contact surface 339.

When the fastener 270 is fastened to the end 262 of the post 264, and when a portion of the nail head 378 contacts at least a portion of the annular contact surface 339, the fastener 270 fastens the first cover body 266 to the end 262 of the post 264, as shown in FIG. 13. Then, as shown in FIG. 13, the second cover body 268 may be coupled to the first cover body 266, by receiving the projection or the generally cylindrical member 370 in the recess 336 in a frictional fit such that the second cover body 268 covers the first and second openings 328 and 334. In the embodiment shown, the first cover body 266 and the second cover body 268 collectively cover a width greater than the width of the end 262 of the post 264, which may protect the end 262 of the post 264 from accumulation of moisture and from damage that may be caused by accumulation of moisture, for example.

Embodiments such as those described herein may cover ends of posts more effectively than other covers for ends of posts. For example, embodiments such as those described herein may cover ends of posts of various different sizes because numerous different portions of inward-facing surfaces (such as the inward-facing surfaces 142, 144, 146, 148, 226, 228, 230, and 232) may contact corner edges (such as the corner edges 122, 124, 126, 128, 206, 208, 210, and 212) of differently sized posts. Specifically, in embodiments such as those described herein, corner edges of smaller posts may contact inward-facing surfaces (such as the inward-facing surfaces 142, 144, 146, 148, 226, 228, 230, and 232) closer to an axis (such as the axis 150 or 234), and corner edges of larger posts may contact such inward-facing surfaces farther from such an axis.

Also, in embodiments such as those described herein, guides (such as guides defined by the adjacent portions of the inward-facing surfaces 142 and 144, of the inward-facing surfaces 144 and 146, of the inward-facing surfaces 146 and 148, of the inward-facing surfaces 148 and 142, of the inward-facing surfaces 226 and 228, of the inward-facing surfaces 228 and 230, of the inward-facing surfaces 230 and 232, or of the inward-facing surfaces 230 and 226, or the guides 346, 348, 350, and 352) may engage vertex regions adjacent respective vertices at ends of differently sized posts along a range of different positions. For example, in embodiments such as those described herein, vertex regions adjacent respective vertices at ends of smaller posts may engage respective guides at positions closer to an axis (such as the central axis 150, 234, or 326) and vertex regions adjacent respective vertices at ends of larger posts may engage respective guides at positions farther from such an axis.

Also, in embodiments such as those described herein, portions of inward-facing surfaces (such as the inward-facing surfaces 142, 144, 146, 148, 226, 228, 230, and 232) may contact entire or substantially entire corner edges (such as the corner edges 122, 124, 126, 128, 206, 208, 210, and 212), and may thereby seal or substantially seal end surfaces (such as the end surfaces 112 and 196) of posts to prevent or substantially prevent moisture from entering spaces above such end surfaces, which may reduce or prevent rot of such posts. Still further, embodiments such as those described herein may form more effective seals than other covers for ends of posts because frictional fits between first cover bodies (such as the first cover bodies 106 and 190) and second cover bodies (such as the second cover bodies 108 and 192) may permit effective seals that may be less likely to be damaged or misaligned than bodies that depend on position or orientation of any other body such as a fastener for example.

Although the inward-facing surfaces 142, 144, 146, 148, 226, 228, 230, and 232 are generally planar, alternative embodiments may include non-planar inward-facing surfaces to create air gaps between the inward-facing surfaces and corner edges of a post. Such air gaps may allow moisture to escape the inside of the cover bodies.

Without limiting any of the embodiments described herein, ornamental designs of the cover assemblies shown in the drawings are also disclosed. In some ornamental designs, the posts form no part of the ornamental designs. In some ornamental designs, the fasteners form no part of the ornamental designs. Some ornamental designs consist of the ornamental features of the cover assemblies visible from above in the orientations shown in the drawings.

Although specific embodiments have been described and illustrated, such embodiments should be considered illustrative only and not as limiting the invention as construed according to the accompanying claims.

The invention claimed is:

1. A method of covering an end of a post, the method comprising:

engaging respective portions of a plurality of guides of a first cover body, said guides being located on an underside of said cover, with respective ones of a plurality of vertex regions adjacent respective ones of a plurality of vertices at the end of the post, wherein the plurality of guides surround a central axis of the first cover body, wherein each of the plurality of guides comprises two generally parallel and spaced-apart members defining a respective channel extending obliquely relative to the central axis of the first cover body, and wherein engaging the respective portions of the plurality of guides with the respective ones of the plurality of vertex regions comprises receiving the respective ones of the plurality of vertex regions in the respective channels of the plurality of guides.

2. The method of claim 1 wherein each of the plurality of vertices is defined by an intersection of:

a respective pair of adjacent ones of a plurality of corner edges, each of the plurality of corner edges between a generally planar end surface of the post and a respective one of a plurality of generally planar lateral surfaces of the post; and a respective one of a plurality of lateral edges, each of the plurality of lateral edges between a respective pair of adjacent ones of the plurality of lateral surfaces of the post.

3. The method of claim 1 wherein the first cover body comprises a plurality of inward-facing surfaces extending obliquely to the central axis of the first cover body.

4. The method of claim 3 wherein the two generally parallel and spaced-apart members of each of the plurality of guides are two generally parallel and spaced-apart projections projecting away from respective adjacent ones of the plurality of inward-facing surfaces.

5. The method of claim 1 further comprising fastening the first cover body to the end of the post.

6. The method of claim 5 wherein fastening the first cover body to the end of the post comprises, when a portion of a fastener separate from the first cover body is received through an opening extending through the first cover body, fastening the fastener to the end of the post.

7. The method of claim 6 wherein fastening the fastener to the end of the post comprises fastening the fastener to the end of the post when the opening extending through the first cover body is entirely spaced apart from the end of the post.

8. The method of claim 6 wherein fastening the fastener to the end of the post comprises fastening the fastener to the end of the post such that the fastener is generally in the same direction as the central axis of the first cover body.

9. The method of claim 6 further comprising coupling a second cover body to the first cover body, independently of any other body, to cover the opening extending through the first cover body.

10. The method of claim 1 wherein engaging the respective portions of the plurality of guides of the first cover body with the respective ones of the plurality of vertex regions comprises aligning the central axis of the first cover body generally in the same direction as a central longitudinal axis of the post.

11. The method of claim 1 wherein engaging the respective portions of the plurality of guides of the first cover body with the respective ones of the plurality of vertex regions comprises aligning the first cover body rotationally about the central axis of the first cover body in a pre-defined rotational orientation relative to the post.

12. An apparatus for covering an end of a post, the apparatus comprising:

a cover body defining a recess and comprising a means for aligning the cover body relative to the post when the end of the post is received in the recess, wherein the means for aligning comprises a plurality of means, in the recess and surrounding a central axis of the cover body, for guiding respective ones of a plurality of vertex regions adjacent respective ones of a plurality of vertices at the end of the post, wherein each of the plurality of means for guiding comprises two generally parallel and spaced-apart members defining a respective channel extending obliquely relative to the central axis of the cover body, wherein the cover body defines sufficient clearance in the recess to receive, in the recess, a generally planar end surface at the end of the post when the plurality of vertex regions are received in respective ones of the channels, the generally planar end surface extending between corner edges of the post extending between respective pairs of the plurality of vertices at the end of the post; and a means for fastening the cover body to the end of the post.

13. The apparatus of claim 12 wherein the means for fastening defines an opening extending through the first cover body for receiving a portion of a fastener separate from the cover body and positionable to fasten the cover body to the end of the post when the plurality of vertex regions are received in the respective ones of the channels.

14. An apparatus for covering an end of a post, the apparatus comprising:

a first cover body defining a recess and comprising a plurality of guides in the recess and surrounding a central axis of the first cover body, each of the plurality of guides comprising two generally parallel and spaced-apart members defining a respective channel extending obliquely relative to the central axis of the first cover body, wherein the first cover body defines sufficient clearance in the recess to receive, in the recess, a generally planar end surface at the end of the post when a plurality of vertex regions adjacent respective ones of a plurality of vertices at the end of the post are received in respective ones of the channels, the generally planar end surface extending between corner edges of the post extending between respective pairs of the plurality of vertices at the end of the post.

15. The apparatus of claim 14 wherein the first cover body comprises a plurality of inward-facing surfaces extending obliquely to the central axis of the first cover body.

16. The apparatus of claim 15 wherein the two generally parallel and spaced-apart members of each of the plurality of guides are two generally parallel and spaced-apart projections projecting away from respective adjacent ones of the plurality of inward-facing surfaces.

17. The apparatus of claim 14 wherein the first cover body defines an opening extending through the first cover body for receiving a portion of a fastener separate from the first cover body and positionable to fasten the first cover body to the end of the post when the plurality of vertex regions are received in the respective ones of the channels.

18. The apparatus of claim 17 wherein the opening extending through the first cover body is positioned to be entirely spaced apart from the end of the post when each of the plurality of vertex regions is received in the respective one of the channels.

19. The apparatus of claim 17 wherein the opening extending through the first cover body is oriented to align the fastener generally in the same direction as the central axis of the first cover body when the fastener is fastened to the end of the post.

20. The apparatus of claim 17 further comprising a second cover body configured to be coupled to the first cover body, independently of any other body, to cover the opening extending through the first cover body.

21. The apparatus of claim 14 wherein the plurality of guides are configured to align the central axis of the first cover body generally in the same direction as a central longitudinal axis of the post as the plurality of vertex regions are received in the respective ones of the channels.

22. The apparatus of claim 14 wherein the plurality of guides are configured to align the first cover body rotationally about the central axis of the first cover body in a pre-defined rotational orientation relative to the post as the plurality of vertex regions are received in the respective ones of the channels.

* * * * *